United States Patent [19]

Hynek et al.

[11] Patent Number: 4,525,403

[45] Date of Patent: Jun. 25, 1985

[54] STABILIZED PILE ARTICLE, PRODUCTION AND USE THEREOF FOR THE TREATMENT OF SURFACES

[75] Inventors: Bernd Hynek, Pulheim; Giselher Valk, Krefeld; Gerhard Treptau, Grefrath, all of Fed. Rep. of Germany

[73] Assignees: Bayer Aktiengesellschaft; Girmes Vertriebsgesellschaft fur Industrietextilien mbH, both of Fed. Rep. of Germany

[21] Appl. No.: 534,329

[22] Filed: Sep. 21, 1983

[30] Foreign Application Priority Data

Oct. 2, 1982 [DE] Fed. Rep. of Germany ..... 3236518

[51] Int. Cl.[3] ..... B32B 3/02; B32B 33/00

[52] U.S. Cl. ..... 428/87; 51/281 R; 51/404; 51/407; 51/DIG. 19; 428/96

[58] Field of Search ..... 428/86, 87, 90, 91, 428/92, 95, 96, 97, 64, 65; 51/DIG. 19, 404, 407, 281 R

[56] References Cited

U.S. PATENT DOCUMENTS

| | | | |
|---|---|---|---|
| 1,425,307 | 8/1922 | Wilson | 428/86 |
| 3,497,414 | 2/1970 | Blue | 428/86 |
| 3,574,106 | 4/1971 | Bragg | 428/86 |
| 3,860,469 | 1/1975 | Gregorian | 428/86 |

*Primary Examiner*—Marion E. McCamish

*Attorney, Agent, or Firm*—Connolly and Hutz

[57] ABSTRACT

Stabilized pile articles, characterized in that the stabilizing has been carried out on the upper surface by means of latices, dispersions and/or resins or by a heat treatment, a process for its production characterized in that an unstabilized pile article is stabilized, and its use for the treatment of surfaces.

6 Claims, 5 Drawing Figures

STABILIZED PILE ARTICLE, PRODUCTION AND USE THEREOF FOR THE TREATMENT OF SURFACES

This invention relates to pile articles stabilized by latices, dispersions or resins or by heat treatment. The present invention also relates to processes for the production of pile articles and to the use thereof for the treatment of surfaces of a wide variety of materials.

It is known that emery-covered fabrics and paper are used for surface treatments. Steel wool and grinding and polishing discs are also used for the treatment of surfaces.

Grinding discs manufactured from non woven fabrics, impregnated with synthetic resin and treated on the grinding surface thereof with an abrasive grain, such as silicon carbide, bonded with a synthetic resin are also in use.

These known grinding discs produced from non woven fabrics have only a limited grinding action and service life which in many cases leaves much to be desired. Due to the structure of the non woven, the upper layer of grinding disc carrying the abrasive corundum is not sufficiently deeply embedded in the fleece and is therefore quickly used up.

In the known products, the surface of the material is very liable to tear under mechanical stress and break down because it is mechanically not sufficiently firmly bonded and such a material may give rise to surface irregularities.

It has now been found that the disadvantages described above may be obviated by means of the pile articles according to the present invention.

Pile articles treated with bonding agents may be used, for example, for the production of grinding discs having a substantially improved service life and grinding or polishing action. The much more favourable performance of grinding and/or polishing discs produced from pile articles is due to the particular arrangement of the fibres of the pile in relation to the non woven. The open pile surface of such a fabric enables the binder required for reinforcing the fabric to penetrate more deeply into the upper layer which may contain grinding particles in addition to the binder. This may explain the improved grinding and/or polishing action of pile fabrics produced according to the present invention.

The present invention is not limited to the formation of grinding or polishing discs in the form of circular discs, but also covers other embodiments.

The elasticity of the product depends on the base layer, which consists of fibres, which can be either free from bonding material, or just weakly bonded. This base layer acts as a cushion which ensures that the surfaces to be treated will not damaged.

If thermoformable binders and thermoformable textile fibres are incorporated in the fabric, the fabric may also be used for treating non-planar surfaces.

The grinding or insulating bands produced from pile articles of any weight per unit area may, for example, be mounted on rotating rollers or tubes or arranged to run as endless grinding belts over the rotating rollers. The grinding materials used may be particles of abrasive material, such as silicon carbide or aluminium oxide. Ultra-hard grits, such as diamond dust or cubic boron nitride, may also be used. The grinding materials and binder together constitute the abrasive upper layer of the grinding disc or belt. Depending on the degree of fineness and quantity of abrasive particles used, the action of the rotating grinding disc changes from a grinding to a polishing process. If polishing alone is required, the addition of abrasive particles may be omitted altogether. In that case, the discs or belts will be impregnated with binder alone.

The present invention thus relates to a stabilized pile article in which the upper surface is stabilized by means of latices, dispersions or resins or by a heat treatment. These stabilized pile articles are obtained by treating unstabilized pile articles with latices, dispersions and resins or by a heat treatment.

The unstabilized pile articles used as starting material may have any height of pile and may be produced by known processes.

Some of these techniques for the production of pile articles are exemplified below.

Tufted pile fabrics with cut or loop pile or a combination of both forms of pile, tufted in straight lines or in patterns.

Woven pile fabric, including warp pile fabric and weft pile fabric.

Chenille fabric, bouclé and epingle.

Stitch knitted pile fabric, e.g. malipol fabric.

Warp knitted pile fabric, e.g. Raschel goods.

Turkish towelling.

Knitted pile, e.g. Wildman fabric.

Pile fabric produced by electrostatic flocking.

Pile fabric produced by finishing processes, e.g. pile fabric obtained by brushing knitted goods or atlas bound weaves.

Pile fabric obtained by cutting and bonding techniques, e.g. the Giroud process, the Bigelow Sanford process, the Bouclé Ondulee process, the Brandon process, the Bartuft process, the Radicliffe process, or the Couquet process.

The yarns used for forming the pile may be obtained from natural or chemical fibres and the latter may be used as endless or spinning fibre yarns.

Natural and chemical fibres may be combined in mixtures in smooth or textured yarns and threads.

The following may be used as backing materials (supports) for the unstabilized pile articles: woven fabrics produced from various fibre materials, e.g. polypropylene (in most cases in the form of split tapes), polyester and jute. Ground weave stitched to a fibre application ("Angel hair"). Knit fabrics of various fibre materials. Non-wovens of various fibre materials:

non woven fabrics spunbonded or needled,
needlefelts,
wadding,
roller felts,
stitch-bonded fabrics,
knit-bonded fabrics.

The following backing constructions, for example, may be used for the pile articles:

primary cloth.
second and multiple backing of textile sheet structures and/or backing coatings.

Sheet structures: e.g. woven fabrics of jute, polyacrylic fibres, or polyesters; non woven fabrics of polypropylene and other fibre materials. Backing or laminating of the various sheet structures with wet adhesives, solvent adhesives and thermoplastic adhesives; also stitching or rivetting.

Backing coatings: e.g. latex foam backings in flat foam, waffle or embossed foam, heavy coating with polyurethane, polyvinyl chloride or atactic polypropylene, possibly with the addition of flat net-like structures for reinforcement.

The latices and dispersions may be prepared in conventional manner from the following copolymerisable monomers:

(a) esters of acrylic and methacrylic acid having from 1 to 18, preferably from 1 to 8, carbon atoms in the alcohol component, for example methylacrylate, methylmethacrylate, ethylacrylate, n-butylacrylate, isobutylacrylate, 2-ethyl-hexylacrylate, and mixtures thereof;

(b) aromatic vinyl compounds and aromatic vinylidene compounds, such as halogenated or alkylated styrenes. The alkyl group on the nucleus preferably contains from 1 to 4 carbon atoms and that of the vinyl group preferably 1 or 2 carbon atoms. The following are examples: styrene, α-methylstyrene, p-methylstyrene, p-isopropylstyrene and p-chlorostyrene;

(c) vinyl esters of carboxylic acids having from 2 to 8 carbon atoms, in particular vinyl acetate, vinyl propionate, vinyl butyrate and vinyl benzoate;

(d) α,β-unsaturated carboxylic acid amides having from 3 to 5 carbon atoms, such as acrylamide and methacrylamide and N-hydroxymethyl derivatives thereof and alkyl ethers thereof having from 1 to 8, in particular from 1 to 4, carbon atoms in the ether alkyl moiety, such as N-hydroxymethyl methacrylamide, N-hydroxymethyl acrylamide, N-butoxymethyl acrylamide, N-butoxymethyl methacrylamide, and esters of carbamic acid;

(e) diene hydrocarbons having from 4 to 6 carbon atoms, and in particular conjugated dienes, e.g. butadiene-(1,3), isoprene, piperylene, hexadiene(1,3), chlorobutadiene-(1,3), 1,2-dichlorobutadiene-(1,3);

(f) α,β-unsaturated nitriles, such as (meth)acrylonitrile; α,β-unsaturated monocarboxylic acids, such as acrylic, itaconic or methacrylic acid; α,β-unsaturated halides, such as vinylchloride, vinylfluoride and vinylbromide.

These monomers may be used, for example, to produce homopolymers and copolymers, copolymers being preferred.

The following, for example, may be used as resins:
melamine/formaldehyde resins,
resorcinol/formaldehyde resins,
urea/formaldehyde resins,
phenol/formaldehyde resins,
cresol resins, reactive resins, urea/melamine/formaldehyde resins and the corresponding derivatives.

Both the stiffness and degree of cross-linking may be increased by the addition of resin-forming, water-soluble formaldehyde condensation products.

The latices used may have a solids content of from 10 to 70%, by weight; the dispersions put into the process, a solids content of from 10 to 70%, by weight, and the resins a solids content of from 10 to 90%, by weight.

The unstabilized pile articles are treated with the above latices, dispersions and/or resins in amounts corresponding to solids contents up to 300%, by weight.

Stabilizing of the pile articles described may be carried out by impregnation, coating, printing and/or spraying in one or more stages.

Mixtures of inorganic grinding materials in various particle sizes, such as silicon carbides, aluminium oxides and derivatives thereof, may be added to the mixtures in quantites of from 0 to 350% , by weight, based on the solids content of the latex, resin or dispersion.

Polyacrylates, methyl celluloses, carboxymethyl-celluloses and alginates may be used to regulate the viscosity of the mixtures.

Curing agents, accelerators, zinc oxides, gelling agents, wetting agents, plasticisers, thermoplasts, fillers, dye pigments of organic or inorganic origin and other conventional auxiliary products for rubber latex dispersions may be added.

The accompanying drawings 1 to 5 illustrate various forms of the reinforced pile fabrics.

FIG. 1 and FIG. 2 each represent a side view of a solid disc (FIG. 1) and an annular disc (FIG. 2).

Figure 5:
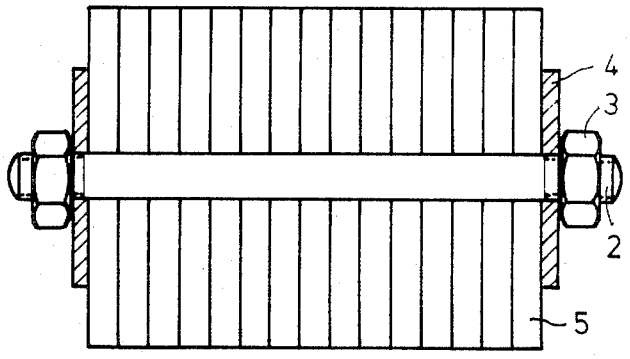

In FIG. 5, the reference numeral 4 represents a support, 3 a nut, 2 a thread and 5 the pile article.

Figure 1:
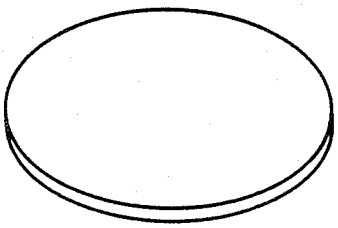

The disc (FIG. 1) has a diameter of from 2 to 100 cm and a thickness of from 0.1 to 10 cm. It is prepared by punching a circular article out of a flat piece of the appropriate thickness.

Figure 2:
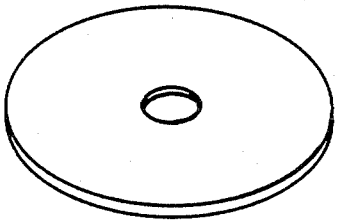

The annular disc (FIG. 2) has an external diameter of from 2 to 100 cm, an internal diameter of from 0.5 to 15 cm and a thickness of from 0.1 to 10 cm. It is produced in the same manner as the disc, but, in addition, another, smaller disc of the required size is punched out of the centre.

Figure 3:
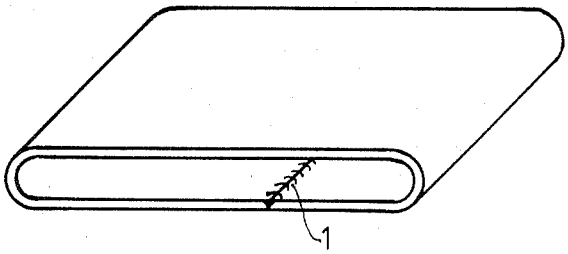
FIG. 3 illustrates an endless grinding belt, the reference numeral 1 indicating the position of the seam.

The grinding belt (FIG. 3) has a width of from 1 to 500 cm, a length of from 10 to 300 cm and a thickness of from 0.1 to 10 cm and is produced by cutting a piece out of a sheet and joining up the ends either mechanically or by glueing.

Figure 4:
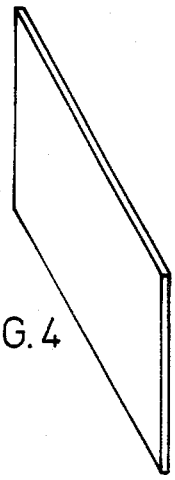
FIG. 4 represents a grinding belt for a cylinder and FIG. 5 a brush roller in side view.

The cylinder grinding belt (FIG. 4) has a width of from 1 to 300 cm, a length of from 3 to 200 cm, a thickness of from 0.1 to 100 cm and a cutting angle of from 20° to 50°. It is produced in the same manner as the grinding belt. It is cut obliquely across its width at an angle within the range mentioned above.

The brush (FIG. 5) has an external diameter of from 3 to 50 cm, an internal diameter of from 0.1 to 10 cm and a length of from 0.5 to 300 cm. The brush roller is produced by mounting several annular discs on a thorn and pressing them together, for example by mechanical pressure.

The composition: of the mixtures is illustrated in the Examples. The numerical data represent parts, by weight, based on 100 parts of the dry substance of latices, dispersions and resins used, unless otherwise indicated.

EXAMPLE 1

Unstabilized tufted raw material with a subdivision of ¼", a polyamide 6, 400 dtex (Nm 2.51) in the pile, a polypropylene non woven as support and an overall weight per unit area of 450 g/m$^2$ is immersed in an aqueous dispersion of 40%, by weight, of butadiene, 55%, by weight, of styrene and 5%, by weight, of a monomer containing carboxyl groups, which dispersion has a solids content of 50% and a pH of 8.5, and the material is then dried at 125° C. The binder uptake is found to be 7% after drying, based on the starting weight of the textile support.

An aqueous mixture is then applied by spraying. This mixture consists of an aqueous dispersion of the following composition: 60%, by weight, of styrene, 30%, by weight, of butadiene, 5%, by weight, of acrylonitrile and 5%, by weight, of N-methylol acrylamide, solids content 50% and pH 5.

50%, by weight, of a melamine/formaldehyde resin and 150%, by weight, of a mixture of corundum and carborundum in proportions by weight of 1:1, grit size 150, are added to this dispersion, 15%, by weight, of a polyacrylate thickener having been added to slow down the rate of settling. After drying and cross-linking, the quantity applied is found to be 240 g/m$^2$.

EXAMPLE 2

Unstabilized tufted raw material from Example 1 is stabilized with a dispersion consisting of 60%, by weight, of acrylic acid esters, 30%, by weight, of styrene, 4%, by weight, of methacrylic acid and 6%, by weight, of N-methylol acrylamide, the dispersion having a solids concentration of 48% and a pH of 5. The material is dried at 125° C. and the solids content taken up amounts to about 10%, based on the starting weight of the fabric support.

Spraying is then carried out as in Example 1.

EXAMPLE 3

Unstabilized tufted raw material from Example 1 is immersed in a latex consisting of 30%, by weight, of acrylonitrile, 65%, by weight, of butadiene, 2%, by weight, of acrylic acid and 3%, by weight, of N-methylol acrylamide, solids content 40%, pH 6. The quantity found to be applied after drying amounts to 13%, based on the weight of the untreated fabric support.

The material is then sprayed with a dispersion composed of 95%, by weight, of (meth)acrylic acid esters and 5% of N-methylol acrylamide, solids concentration 40% and pH 6.

40%, by weight, of a melamine/formaldehyde resin are added to this dispersion and the amount finally found to be applied after drying is 100 g/m$^2$.

EXAMPLE 4

Unstabilized tufted raw material from Example 1 is used. Preliminary strengthening is carried out as described in Example 1. Pressure application is carried out using a dispersion of 40%, by weight, of butadiene, 35%, by weight, of styrene, 4%, by weight, of (meth)acrylic acid, 7%, by weight, of (N-methylol)acrylamide and 14%, by weight, of acrylonitrile, the dispersion having a concentration of 40% and pH 8.

To this dispersion, are added about 50%, by weight, of a melamine/formaldehyde resin and 100%, by weight, of a corundum having a grain size of 100. 25%, by weight of a polyacrylate thickener are added to form a suitable paste.

The average quantity found to be applied after drying and cross-linking is about 120 g/m$^2$.

EXAMPLE 5

Pile articles as described in Example 1 are sprayed directly as in Example 1.

EXAMPLE 6

Pile articles as described in Example 1 are first impregnated with the following mixture, as explained in Example 1. This mixture consists of 125%, by weight, of melamine/formaldehyde resin, 10%, by weight, of ammonium chloride, 125%, by weight, of corundum with a fineness of 220 and 2.5%, by weight, of a methyl cellulose.

EXAMPLE 7

Pile articles as described in Example 1 are again reinforced as described in Example 1, the spray mixture consisting of 250%, by weight, of an aqueous phenol/formaldehyde resin, 100%, by weight, of formaldehyde, 125%, by weight, of corundum with fineness of 100 and 100%, by weight, of a polyacrylate thickener.

The pile articles equipped with a coating which may contain or be free from emery are delivered in the treated state, with or without turning down of the edges, or binding off. These fabrics are resistant to washing and dry cleaning.

We claim:

1. A pile article stabilized on the upper surface thereof by an aqueous polymer dispersion, the quantity of the dispersion being up to 300%, by weight, based on the solids content, and containing up to 350%, by weight, of an abrasive material, based on the unstabilized pile article.

2. A grinding and polishing article consisting of a pile fabric stabilized on the upper surface by an aqueous polymer dispersion, the quantity of the dispersion being up to 300%, by weight, based on the solids content, and containing up to 350%, by weight, of an abrasive material, based on the unstabilized pile fabric.

3. A pile article as in claim 2 wherein the aqueous polymer dispersion also contains a water-soluble formaldehyde resin.

4. A pile article as in claim 2 wherein the quantity of the applied dispersion in terms of the solids content thereof, is from 20 to 500 g/m$^2$, based on the weight of the unstabilized pile fabric.

5. A process for the production of a pile article comprising stabilizing a pile fabric by adding up to 300%, by weight, based on the solids content, of an aqueous polymer dispersion, and adding up to 350%, by weight, of an abrasive material, based on the unstabilized pile fabric.

6. A process as in claim 5 wherein the dispersion has a solids content of from 10 to 70%, by weight.

* * * * *